US008741002B2

(12) United States Patent
Felix-Moore et al.

(10) Patent No.: US 8,741,002 B2
(45) **Date of Patent: *Jun. 3, 2014**

(54) GASOLINE COMPOSITIONS

(75) Inventors: Allison Felix-Moore, Chester (GB); Jean-Paul Lange, Amsterdam (NL); Johanne Smith, Chester (GB)

(73) Assignee: Shell Oil Company, Houston, TX (US)

( * ) Notice: Subject to any disclaimer, the term of this patent is extended or adjusted under 35 U.S.C. 154(b) by 207 days.

This patent is subject to a terminal disclaimer.

(21) Appl. No.: 12/787,261

(22) Filed: May 25, 2010

(65) Prior Publication Data

US 2011/0041792 A1 Feb. 24, 2011

(30) Foreign Application Priority Data

May 25, 2009 (EP) ..... 09160983

(51) Int. Cl.
*C10L 1/18* (2006.01)

(52) U.S. Cl.
USPC ..... 44/388

(58) Field of Classification Search
USPC ..... 44/352, 388, 448, 451
See application file for complete search history.

(56) References Cited

U.S. PATENT DOCUMENTS

| | | | | |
|---|---|---|---|---|
| 3,282,662 | A * | 11/1966 | Henderson | 44/388 |
| 3,563,715 | A | 2/1971 | Richardson | 44/66 |
| 5,606,102 | A | 2/1997 | Fauconet et al. | 560/205 |
| 5,855,629 | A | 1/1999 | Grundy et al. | 44/400 |
| 6,156,082 | A | 12/2000 | MacMillan et al. | 44/398 |
| 6,923,839 | B2 * | 8/2005 | Stickney et al. | 44/388 |
| 2001/0024966 | A1 | 9/2001 | Miller et al. | 455/569 |
| 2001/0034966 | A1 | 11/2001 | Golubkov et al. | 44/329 |
| 2002/0026744 | A1 | 3/2002 | Golubkov et al. | 44/436 |

FOREIGN PATENT DOCUMENTS

| | | | |
|---|---|---|---|
| EP | 499731 | 8/1992 | C07C 67/31 |
| EP | 780460 | 6/1997 | C10L 1/14 |
| EP | 1731589 | 12/2006 | C10L 10/16 |
| FR | 2757539 | 6/1998 | |
| GB | 1174148 | 8/1967 | C07C 59/54 |
| JP | 5821630 | 2/1983 | C07C 27/00 |
| JP | 02164848 | 6/1990 | C07C 67/02 |
| WO | WO 9404636 | 3/1994 | C10L 10/02 |

OTHER PUBLICATIONS

Written Opinion, PCT International Searching Authority, International Application No. PCT/EP2010/057132, May 25, 2010(PCT Rule 43).

European Search Report, Application No. EP 2010/057132, Aug. 10, 2010.

* cited by examiner

*Primary Examiner* — Cephia D Toomer

(57) ABSTRACT

An unleaded gasoline composition comprising:

(i) a gasoline base fuel; and (ii) component A, wherein component A is an alkyl alkenoate compound, or a mixture of alkyl alkenoate compounds, selected from compounds of formula I:

(I)

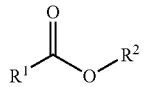

wherein $R^1$ is a linear alkenyl group containing 3 to 5 carbon atoms, optionally substituted by a methyl group, and $R^2$ is a linear or branched alkyl group containing 1 to 6 carbon atoms. The gasoline composition of the present invention exhibits good lubricity. The gasoline composition of the invention in another aspect provides increased sensitivity.

16 Claims, No Drawings

GASOLINE COMPOSITIONS

FIELD OF THE INVENTION

The present invention relates to gasoline compositions, and in particular to gasoline compositions having improved lubricity.

BACKGROUND OF THE INVENTION

Esters are known components for use in fragrance and flavouring applications.

Unsaturated esters have previously been used in diesel fuel applications; in particular, when the unsaturated esters are in the form of, or contained within, fatty acid methyl ester (FAME) compositions.

EP 1731589 A2 discloses palm-based biodiesel formulations with enhanced cold flow properties. Alkyl esters of $C_6$-$C_{18}$ saturated or unsaturated fatty acids are disclosed as one possible component of the biodiesel.

In U.S. Pat. No. 3,563,715, acrylic acid, methacrylic acid, dimethylacrylic acid, and tert-butyl methacrylate have been shown as some of many monocarboxylic acids and derivatives that increase the octane rating (RON) of leaded hydrocarbon fuels; the effect of those unsaturated components on MON octane rating is not recorded. U.S. Pat. No. 3,563,715 also documents that such 'lead extenders' have no effect on octane rating when used in unleaded hydrocarbon fuels.

Ethyl acrylate is also noted, but not demonstrated, as a potential high octane organic compound that could be used alongside organomagnesium compounds in unleaded gasolines in WO 94/04636.

Low carbon number acrylates and methacrylates, for example methyl, ethyl and tert-butyl acrylates and methacrylates, are known to be skin sensitisers, where even a small amount, eg 0.1 wt %, can trigger a problem. Therefore it is undesirable to use such compounds as a component of a gasoline composition.

US 2002/0026744 A1 discloses motor fuel compositions comprising an oxygen-containing component and optionally a hydrocarbon component. The oxygen-containing component disclosed therein comprises a mixture of organic compounds having oxygen-containing functional groups. The oxygen-containing functional groups disclosed therein include alcohols, ethers, aldehydes, ketones, esters, inorganic acid esters, acetals, epoxides and peroxides. The motor fuel compositions of US 2002/0026744 A1 were used as a fuel for various diesel, jet, gas-turbine and turbojet engines.

Esters as a general class of compounds alongside ethers, alcohols, ketones and other oxygenated components, are also proposed as additives for fuels in EP 780460 A1, U.S. Pat. No. 6,156,082, and US 2001/0024966 A1, to improve lubricity or vapour pressure properties. None of those documents however specifically disclose or exemplify the use of low carbon number alkyl alkenoate compounds. EP 780460 A1 is primarily concerned with compatibilisers for Tolad 9103, a mixture of polymerised and non-polymerised fatty acids and heavy aromatic naphtha; U.S. Pat. No. 6,156,082 is concerned with a class of esterified alkenyl succinic acids; and US 2001/0024966 A1 documents the preferred use of $C_5$-$C_8$ alkyl esters of saturated carboxylic acids.

FR 2757539 A1 discloses a fuel and a process for manufacturing a fuel from vegetable matter. The process disclosed involves the production of esters from vegetable matter, and the inclusion of them in a fuel.

SUMMARY OF THE INVENTION

According to the present invention there is provided an unleaded gasoline composition comprising:

(i) a gasoline base fuel; and (ii) component A, wherein component A is an alkyl alkenoate compound, or a mixture of alkyl alkenoate compounds, selected from compounds of formula I:

(I)

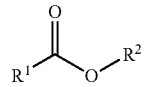

wherein $R^1$ is a linear alkenyl group containing 3 to 5 carbon atoms, optionally substituted by a methyl group, and $R^2$ is a linear or branched alkyl group containing 1 to 6 carbon atoms.

According to the present invention there is further provided a method of operating an internal combustion engine, typically a spark-ignition internal combustion engine, which method involves introducing into a combustion chamber of the engine an unleaded gasoline composition as described herein.

DETAILED DESCRIPTION OF THE INVENTION

It has now been found that certain alkyl alkenoate compounds are suitable components for use in gasoline compositions, and that such alkyl alkenoate compounds can also provide benefits in terms of improved lubricity of the gasoline composition.

The unleaded gasoline composition herein comprises component A, wherein component A is an alkyl alkenoate compound, or a mixture of alkyl alkenoate compounds, selected from compounds of formula I:

(I)

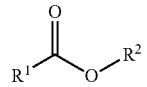

wherein $R^1$ is a linear alkenyl group containing 3 to 5 carbon atoms, optionally substituted by a methyl group, and $R^2$ is a linear or branched alkyl group containing 1 to 6 carbon atoms.

Preferably, the $R^1$ group is an alkenyl group which contains 3 or 4 carbon atoms, and especially 4 carbon atoms. A particularly preferred $R^1$ group is an unsubstituted linear alkenyl group containing 4 carbon atoms. Typically, the carbon chain of the $R^1$ group will only contain a single point of unsaturation (mono-olefinic).

Preferably, the $R^2$ group is an alkyl group which contains from 1 to 5 carbon atoms, more preferably from 1 to 4 carbon atoms, and especially from 2 to 4 carbon atoms. A particularly preferred $R^2$ group is a linear alkyl group containing from 2 to 4 carbon atoms. Examples of particularly preferred $R^2$ groups include methyl, ethyl, propyl, iso-propyl, butyl, iso-butyl, and tert-butyl groups. An especially preferred $R^2$ group is ethyl.

Component A preferably has a boiling point, or boiling point range having an upper limit, of at most 210° C. However, more preferably component A has a boiling point, or boiling point range, of at most 200° C., at most 190° C., at most 180° C., at most 170° C., or at most 160° C. Component A preferably has a boiling point, or boiling point range having a lower limit, of at least 40° C. However, more preferably component A has a boiling point, or boiling point range having a lower limit, of at least 50° C., at least 60° C., at least 70° C., at least 80° C., at least 90° C., or at least 100° C.

Typically, the boiling point, or boiling point range, of component A is within a range having a lower limit selected from any one of 40° C., 50° C., 60° C., 70° C., 80° C., 90° C., and 100° C., and an upper limit selected from any one of 210° C., 200° C., 190° C., 180° C., 170° C., and 160° C.

Examples of suitable compounds according to formula I include methyl butenoate, ethyl butenoate, propyl butenoate, butyl butenoate, methyl pentenoate, ethyl pentenoate, propyl pentenoate, butyl pentenoate, methyl hexenoate, ethyl hexenoate, propyl hexenoate, butyl hexenoate, their methyl substituted analogues and mixtures thereof. The isomers, whether they are stereoscopic isomers or structural isomers, of each of the aforementioned compounds are also explicitly covered by the present invention.

Most preferably component A comprises or is ethyl pentenoate, which may be in the form of any single isomer, such as ethyl 2-pentenoate, ethyl 3-pentenoate or ethyl 4-pentenoate, or a mixture of any two or more isomers.

When in mixed isomer form, the primary isomer present is most suitably the trans-isomer of ethyl 3-pentenoate, which may suitably be present in an amount of from 45 to 50 wt % of the total amount of isomers present. The cis-isomer of ethyl 3-pentenoate and ethyl 4-pentenoate may suitably be present each in an amount in the range of from 20 to 25 wt % of the total of mixed isomers. Ethyl 2-pentenoate may also suitably be present for example in an amount in the range of from 5 to 10 wt % of the total isomer mixture. Naturally the total percentage of ethyl pentenoate, in whatever isomeric form present in the isomer mixture, cannot exceed 100 wt %. It is possible, depending on the origin of the isomeric mixture, for minor amounts, e.g. less than 2 wt %, of other compounds, for example diethyl ether and/or unreacted starting materials, to be present in the isomer mixture. Such components may be present for example in an amount in the range of from 0.1 to 1.5 wt % of the total mixture.

Component A can conveniently be derived from a biological source using methods known in the art and therefore can be included in a gasoline composition as a biofuel component.

The gasoline composition according to the present invention may be prepared by blending the base gasoline with component A.

The gasoline composition according to the present invention comprises a gasoline base fuel and component A. Preferably, the gasoline composition according to the present invention comprises a gasoline base fuel and at least 0.5 vol. %, based on the overall gasoline composition, of component A. More preferably, the gasoline composition according to the present invention comprises a gasoline base fuel and from 0.5 to 30 vol. %, based on the overall gasoline composition, of component A. Typically, the amount of component A in the gasoline composition according to the present invention, based on the overall gasoline composition, is in a range formed by the combination of one parameter selected from parameters (a) to (i) and one parameter selected from parameters (j) to (r):

(a) at least 1.0 vol. %
(b) at least 1.5 vol. %
(c) at least 2.0 vol. %
(d) at least 2.5 vol. %
(e) at least 3.0 vol. %
(f) at least 3.5 vol. %
(g) at least 4.0 vol. %
(h) at least 4.5 vol. %
(i) at least 5.0 vol. %
(j) at most 30 vol. %
(k) at most 28 vol. %
(l) at most 26 vol. %
(m) at most 25 vol. %
(n) at most 24 vol. %
(o) at most 23 vol. %
(p) at most 22 vol. %
(q) at most 21 vol. %
(r) at most 20 vol. %

Preferred combinations include (a) and (j), (b) and (k), (c) and (l), (d) and (m), (e) and (n), (f) and (o), (g) and (p), (h) and (q), and (i) and (r).

The gasoline base fuel used in the gasoline compositions described herein may be any gasoline suitable for use in an internal combustion engine of the spark-ignition (petrol) type known in the art.

The gasoline base fuel typically comprises mixtures of hydrocarbons boiling in the range from 25 to 230° C. (EN-ISO 3405), the optimal ranges and distillation curves typically varying according to climate and season of the year. The hydrocarbons in a gasoline base fuel may be derived by any means known in the art, conveniently the hydrocarbons may be derived in any known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline base fuel are not critical.

Conveniently, the research octane number (RON) of the gasoline base fuel may be at least 80, for instance in the range of from 80 to 110, preferably the RON of the gasoline base fuel will be at least 90, for instance in the range of from 90 to 110, more preferably the RON of the gasoline base fuel will be at least 91, for instance in the range of from 91 to 105, even more preferably the RON of the gasoline base fuel will be at least 92, for instance in the range of from 92 to 103, even more preferably the RON of the gasoline base fuel will be at least 93, for instance in the range of from 93 to 102, and most preferably the RON of the gasoline base fuel will be at least 94, for instance in the range of from 94 to 100 (EN 25164); the motor octane number (MON) of the gasoline base fuel may conveniently be at least 70, for instance in the range of from 70 to 110, preferably the MON of the gasoline base fuel will be at least 75, for instance in the range of from 75 to 105, more preferably the MON of the gasoline base fuel will be at least 80, for instance in the range of from 80 to 100, most preferably the MON of the gasoline base fuel will be at least 82, for instance in the range of from 82 to 95 (EN 25163).

Typically, gasoline base fuels comprise components selected from one or more of the following groups; saturated hydrocarbons, olefinic hydrocarbons, aromatic hydrocarbons, and oxygenated hydrocarbons. Conveniently, the gasoline base fuel may comprise a mixture of saturated hydrocarbons, olefinic hydrocarbons, aromatic hydrocarbons, and, optionally, oxygenated hydrocarbons.

Typically, the olefinic hydrocarbon content of the gasoline base fuel is in the range of from 0 to 40 percent by volume based on the gasoline base fuel; preferably, the olefinic hydrocarbon content of the gasoline base fuel is in the range of from 0 to 30 percent by volume based on the gasoline base fuel.

Typically, the aromatic hydrocarbon content of the gasoline base fuel is in the range of from 0 to 70 percent by volume based on the gasoline base fuel; preferably, the aromatic hydrocarbon content of the gasoline base fuel is in the range of from 10 to 60 percent by volume based on the gasoline base fuel.

The benzene content of the gasoline base fuel is at most 10 percent by volume, more preferably at most 5 percent by volume, especially at most 1 percent by volume based on the gasoline base fuel.

Typically, the saturated hydrocarbon content of the gasoline base fuel is at least 40 percent by volume based on the gasoline base fuel; preferably, the saturated hydrocarbon content of the gasoline base fuel is in the range of from 40 to 80 percent by volume based on the gasoline base fuel.

The gasoline base fuel preferably has a low or ultra low sulphur content. Typically the gasoline composition has a sulphur content of at most 1000 ppmw (parts per million by weight), preferably no more than 500 ppmw, more preferably no more than 100, even more preferably no more than 50 and most preferably no more than even 10 ppmw, relative to the weight of the gasoline composition.

The gasoline base fuel is unleaded, i.e. lead-free, having no lead compounds, such as tetraethyl lead, added thereto. Most preferably the gasoline base fuel has at most a very low total lead content, such as at most 0.005 g/l.

When the gasoline comprises oxygenated hydrocarbons, at least a portion of non-oxygenated hydrocarbons will be substituted for oxygenated hydrocarbons.

The oxygenated hydrocarbons that may be included in the gasoline base fuel are oxygenated components other than those of component A described herein. For example, these can include alcohols, ethers, esters, ketones, aldehydes, carboxylic acids and their derivatives, and oxygen containing heterocyclic compounds. Preferably, the oxygenated hydrocarbons that may be incorporated into the gasoline base fuel are selected from alcohols (such as methanol, ethanol, propanol, iso-propanol, butanol, tert-butanol and iso-butanol), ethers (preferably ethers containing 5 or more carbon atoms per molecule, e.g., methyl tert-butyl ether) and esters other than those of component A (preferably esters containing 5 or more carbon atoms per molecule); a particularly preferred oxygenated hydrocarbon is ethanol.

When oxygenated hydrocarbons are present in the gasoline base fuel, the amount of oxygenated hydrocarbons in the gasoline base fuel may vary over a wide range. For example, gasolines comprising a major proportion of oxygenated hydrocarbons are currently commercially available in countries such as Brazil and U.S.A, e.g. ethanol per se and E85, as well as gasolines comprising a minor proportion of oxygenated hydrocarbons, e.g. E10 and E5. Therefore, the gasoline base fuel may contain up to 100 percent by volume oxygenated hydrocarbons. Preferably, the amount of oxygenated hydrocarbons present in the gasoline base fuel is selected from one of the following amounts: up to 85 percent by volume; up to 65 percent by volume; up to 30 percent by volume; up to 20 percent by volume; up to 15 percent by volume; and, up to 10 percent by volume, depending upon the desired final formulation of the gasoline. Conveniently, the gasoline base fuel may contain at least 0.5, 1.0 or 2.0 percent by volume oxygenated hydrocarbons.

Examples of suitable gasoline base fuels include gasoline base fuels which have an olefinic hydrocarbon content of from 0 to 20 percent by volume (ASTM D1319), an oxygen content of from 0 to 5 percent by weight (EN 1601), an aromatic hydrocarbon content of from 0 to 50 percent by volume (ASTM D1319) and a benzene content of at most 1 percent by volume.

Whilst not critical to the present invention, the gasoline base fuel or the gasoline composition of the present invention may conveniently additionally include one or more fuel additive. The concentration and nature of the fuel additive(s) that may be included in the gasoline base fuel or the gasoline composition of the present invention is not critical. Non-limiting examples of suitable types of fuel additives that can be included in the gasoline base fuel or the gasoline composition of the present invention include anti-oxidants, corrosion inhibitors, detergents, dehazers, antiknock additives, metal deactivators, valve-seat recession protectant compounds, dyes, friction modifiers, carrier fluids, diluents and markers. Examples of suitable such additives are described generally in U.S. Pat. No. 5,855,629.

Conveniently, the fuel additives can be blended with one or more diluents or carrier fluids, to form an additive concentrate, the additive concentrate can then be admixed with the gasoline base fuel or the gasoline composition of the present invention.

The (active matter) concentration of any additives present in the gasoline base fuel or the gasoline composition of the present invention is preferably up to 1 percent by weight, more preferably in the range from 5 to 1000 ppmw, advantageously in the range of from 75 to 300 ppmw, such as from 95 to 150 ppmw.

A gasoline composition according to the present invention may be prepared by a process which comprises bringing into admixture with the base gasoline, component A and optionally one or more fuel additive.

It has been found that the use of component A in the gasoline compositions according to the present invention can provide significant benefits in terms of improved lubricity of the gasoline composition, relative to the gasoline base fuel.

By the term "improved/improving lubricity" used herein, it is meant that the wear scar produced using a high frequency reciprocating rig (HFRR), as measured using the HFRR Lubricity Wear Scar Test Method described herein below, is reduced.

Therefore, a further aspect of the present invention provides for the use of component A in a gasoline composition comprising a major portion of a gasoline base fuel, for improving the lubricity of the gasoline composition relative to the gasoline base fuel.

It has additionally been found that the use of component A in the gasoline compositions according to the present invention can also provide benefits in terms of increased research octane number (RON) relative to the gasoline base fuel.

Whilst it has been found that the use of component A in the gasoline compositions according to the present invention can also provide benefits in terms of increased RON relative to the gasoline base fuel, the use of component A in the gasoline compositions according to the present invention does not provide the same level of increase of the motor octane number (MON) of the gasoline base fuel, and in some circumstances may result in a decrease in the MON of the gasoline base fuel, and therefore the use of component A in the gasoline compositions according to the present invention can also provide benefits in terms of increased sensitivity (Sensitivity=RON−MON) relative to the gasoline base fuel.

It has additionally been found that the use of component A in the gasoline compositions according to the present invention can also provide benefits in terms of reduced Reid Vapour Pressure relative to the gasoline base fuel.

The present invention also provides a method of operating a internal combustion engine, typically a spark-ignition internal combustion engine, which comprises bringing into one or more of the combustion chambers of said engine a gasoline composition as described herein.

The present invention will be further understood from the following examples. Unless otherwise indicated, parts and percentages (concentration) are by volume (% v/v) and temperatures are in degrees Celsius (° C.).

EXAMPLES

Examples 1 to 4 and Comparative Example A

Gasoline Compositions Comprising Ethyl 4-pentenoate

To prepare the gasoline compositions used in Examples 1 and 2, 5 vol. % and 10 vol. % of ethyl 4-pentenoate (ex Bedoukian Chemicals) was admixed with an unleaded gasoline base fuel (compliant with the EN 228 gasoline specification) at ambient temperature.

The properties of the gasoline base fuel (Base #1) and the gasoline compositions containing 5 and 10 vol. % ethyl 4-pentenoate (Examples 1 and 2 respectively) are detailed in Table 1 below.

TABLE 1

| Property | Base #1 | Example 1 | Example 2 |
|---|---|---|---|
| Density at 15° C. (IP 365) | 738.9 | 747.9 | 755.9 |
| RON (ASTM D 2699) | 95.1 | 95.7 | 96.4 |
| MON (ASTM D 2700) | 85.8 | 85.7 | 86.1 |
| Sensitivity | 9.3 | 10.0 | 10.3 |
| Distillation (° C.) (IP 123) | | | |
| IBP | 28.2 | 30.8 | 31.4 |
| 10% evap | 43.8 | 49.2 | 50.2 |
| 20% evap | 58.7 | 64.6 | 66.7 |
| 30% evap | 75.1 | 81.3 | 84.7 |
| 40% evap | 90.3 | 95.8 | 99.1 |
| 50% evap | 102 | 106.4 | 109.6 |
| 60% evap | 110.7 | 115.2 | 118.6 |
| 70% evap | 119.9 | 124.5 | 128.5 |
| 80% evap | 134.2 | 138.0 | 140.3 |
| 90% evap | 158.0 | 157.5 | 156.2 |
| 95% evap | 175.5 | 173.7 | 171.7 |
| FBP | 203.4 | 204.6 | 204.8 |
| Recovery | 95.1 | 96.3 | 96.5 |
| Residue | 0.9 | 0.9 | 1 |
| Loss | 4.0 | 2.8 | 2.5 |
| Evaporation (vol. %) (IP 123) | | | |
| at 70° C. | 26.9 | 23.2 | 21.8 |
| at 100° C. | 48.0 | 43.4 | 40.7 |
| at 120° C. | 70.0 | 65.3 | 61.5 |
| at 150° C. | 86.8 | 86.7 | 86.9 |
| at 180° C. | 96.0 | 96.3 | 96.5 |
| RVP (kPa) (IP 394) | 93.4 | 88.2 | 84.8 |

As can clearly be seen from Table 1, the gasoline compositions containing the ethyl 4-pentenoate (Examples 1 and 2) provided gasoline compositions having an increased research octane number (RON) and an increased sensitivity (RON–MON) relative to the gasoline base fuel. Additionally, the gasoline compositions containing the ethyl 4-pentenoate (Examples 1 and 2) provided gasoline compositions having a reduced Reid Vapour Pressure (RVP) relative to the gasoline base fuel.

HFRR Lubricity Wear Scar Test Method

The lubricity of gasoline compositions was determined by using a modified HFRR (high frequency reciprocating rig) Lubricity Wear Scar test. The modified HFRR test is based on ISO12156-1 using a PCS Instruments HFRR supplemented with the PCS Instruments Gasoline Conversion Kit, and using a fluid volume of 15.0 ml (+/−0.2 ml), a fluid temperature of 25.0° C. (+/−1° C.), and wherein a PTFE cover is used to cover the test sample in order to minimise evaporation.

The results recorded in Table 2 below details the average recorded wear scar for a gasoline base fuel (Base #1 detailed in Table 1 above) (Comparative Example A), the gasoline composition of Example 1 (Example 3) and a gasoline composition containing 20 vol. % ethyl 4-pentenoate admixed with the gasoline base fuel (Base #1) (Example 4).

TABLE 2

| Example | Fuel | Average wear scar (μm) |
|---|---|---|
| A* | Base #1 | 825 |
| 3 | Example 2 | 388 |
| 4 | Base #1 + 20% v/v E4-P | 380.5 |

*Comparative Example

As can be seen from the results in Table 2, a reduced average wear scar is observed in the HFRR Lubricity Wear Scar test for the gasoline compositions containing ethyl 4-pentenoate (Examples 3 and 4), are reduced compared to the gasoline base fuel (Comparative Example A), which represents an improvement in the lubricity of the gasoline composition compared to the base gasoline.

Examples 5 and 6

Gasoline Compositions Comprising a Mixed Isomer Ethyl Pentenoate Component

To prepare the gasoline compositions used in Examples 5 and 6, 5 vol. % and 10 vol. % of a mixed isomer ethyl pentenoate component was admixed with an unleaded gasoline base fuel (compliant with the EN 228 gasoline specification) at ambient temperature.

The mixed isomer ethyl pentenoate component was prepared in accordance with the process described in WO 2005/058793 A1 and the composition of the mixed isomer ethyl pentenoate component determined by $^{13}C$ NMR analysis is detailed in Table 3 below.

TABLE 3

| Component | Mole % | Weight % |
|---|---|---|
| Unreacted gamma valerolactone | 0.0 | 0.0 |
| Unreacted ethanol | 0.0 | 0.0 |
| Diethyl ether | 2.0 | 1.2 |
| Ethyl 2-pentenoate | 6.0 | 6.0 |
| Ethyl 3-pentenoate (trans) | 47.7 | 48.1 |
| Ethyl 3-pentenoate (cis) | 22.6 | 22.7 |
| Ethyl 4-pentenoate | 21.8 | 22.0 |

The properties of the gasoline base fuel (Base #2) and the gasoline compositions containing 5 and 10 vol. % of the mixed isomer component ethyl pentenoate (Examples 5 and 6 respectively) are detailed in Table 4 below.

TABLE 4

| Property | Base #2* | Example 5 | Example 6 |
|---|---|---|---|
| Density at 15° C. (IP 365) | 738.5 | 751.1 | 761.8 |
| RON (ASTM D 2699) | 95.1 | 95.3 | 95.8 |
| MON (ASTM D 2700) | 85.4 | 85.3 | 85.4 |
| Sensitivity | 9.7 | 10.0 | 10.4 |
| Distillation (° C.) (IP 123) | | | |
| IBP | 27.3 | 26.6 | 27.4 |
| 10% evap | 43.6 | 46.7 | 45.8 |
| 20% evap | 58.6 | 62.2 | 63.9 |
| 30% evap | 75.2 | 80.7 | 82.7 |
| 40% evap | 90.5 | 95.2 | 98.5 |

TABLE 4-continued

| Property | Base #2* | Example 5 | Example 6 |
|---|---|---|---|
| 50% evap | 102.2 | 105.8 | 109.1 |
| 60% evap | 111.0 | 114.8 | 119.0 |
| 70% evap | 120.2 | 124.6 | 130.1 |
| 80% evap | 134.8 | 13.8 | 142.9 |
| 90% evap | 159.5 | 158.5 | 156.4 |
| 95% evap | 175.6 | 173.0 | 169.2 |
| FBP | 203.6 | 200.2 | 196.4 |
| Recovery | 95.5 | 95.8 | 95.3 |
| Residue | 1.0 | 1.0 | 1.0 |
| Loss | 3.5 | 3.2 | 3.7 |
| Evaporation (vol. %) (IP 123) | | | |
| at 70° C. | 26.9 | 24.3 | 23.2 |
| at 100° C. | 47.8 | 44.1 | 41.1 |
| at 120° C. | 69.7 | 65.4 | 60.9 |
| at 150° C. | 86.5 | 86.1 | 85.8 |
| at 180° C. | 95.9 | 96.3 | 96.8 |
| RVP (kPa) (IP 394) | 93.4 | 85.7 | 81.6 |

*Base #2 is the same fuel as Base #1; however, the properties of the base fuel were re-measured at the same time and under the same conditions as the properties of the fuel blends of Example 5 and Example 6, and these recorded properties are reported above.

As can clearly be seen from Table 4, the gasoline compositions containing the mixed isomer ethyl pentenoate component (Examples 5 and 6) provided gasoline compositions having an increased research octane number (RON) and an increased sensitivity (RON−MON) relative to the gasoline base fuel. Additionally, the gasoline compositions containing the mixed isomer ethyl pentenoate component (Examples 5 and 6) provided gasoline compositions having a reduced Reid Vapour Pressure (RVP) relative to the gasoline base fuel.

Examples 7 and 8 and Comparative Example B

Gasoline Lubricity Tests

Using the modified HFRR (high frequency reciprocating rig) Lubricity Wear Scar test described above, the lubricity of a gasoline base fuel (Base #1/Base #2) (Comparative Example A), the gasoline composition according to Example 6 (Example 7), and a gasoline composition containing 10 vol. % of ethyl 4-pentenoate admixed with the gasoline base fuel (Example 8). The results of these tests are recorded in Table 5 below.

TABLE 5

| Example | Fuel | Average wear scar (μm) |
|---|---|---|
| A* | Base #1 | 825 |
| 7 | Example 6 | 357 |
| 8 | Example 2 | 388 |

*Comparative Example

As can be seen from the results in Table 5, a reduced average wear scar is observed in the HFRR Lubricity Wear Scar test for the gasoline compositions containing both the mixed isomer ethyl pentenoate component and ethyl 4-pentenoate (Examples 7 and 8), compared to the gasoline base fuel (Comparative Example B), which represents an improvement in the lubricity of the gasoline composition compared to the base gasoline.

It may also be noted that the average wear scar for the gasoline composition containing the mixed isomer ethyl pentenoate component is smaller than for the gasoline composition containing ethyl 4-pentenoate.

What is claimed is:

1. An unleaded gasoline composition comprising:

(i) an unleaded gasoline base fuel; and (ii) component A, wherein component A is an alkyl alkenoate compound, or a mixture of alkyl alkenoate compounds, selected from compounds of formula I:

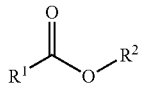

(I)

wherein $R^1$ is a linear alkenyl group containing 3 to 5 carbon atoms, optionally substituted by a methyl group, and $R^2$ is a linear or branched alkyl group containing 1 to 6 carbon atoms wherein the concentration of component A is in the range of from 2.5 to 25 vol. %, based on the overall gasoline composition.

2. The gasoline composition of claim 1 wherein component A has a boiling point in the range of from 40 to 210° C.

3. The gasoline composition of claim 1 wherein, in component A, $R^1$ is an unsubstituted linear alkenyl group containing 4 carbon atoms, and $R^2$ is a linear or branched alkyl group containing 2 to 4 carbon atoms.

4. The gasoline composition of claim 3 wherein component A is ethyl pentenoate.

5. The gasoline composition of claim 4 wherein component A is a mixture of isomers of ethyl pentenoate.

6. The gasoline composition of claim 1 wherein the gasoline composition additionally comprises one or more fuel additive.

7. A method of operating an internal combustion engine, which method involves introducing into one or more of the combustion chambers of the engine an unleaded gasoline composition of claim 1.

8. A method of operating an internal combustion engine, which method involves introducing into one or more of the combustion chambers of the engine an unleaded gasoline composition of claim 2.

9. A method of operating an internal combustion engine, which method involves introducing into one or more of the combustion chambers of the engine an unleaded gasoline composition of claim 3.

10. The gasoline composition of claim 5 wherein component A comprises a mixture of at least two isomers of ethyl pentenoate selected from ethyl 2-pentenoate, ethyl 3-pentenoate, and ethyl 4-pentenoate.

11. The gasoline composition of claim 5, wherein component A comprises at least 45 wt % of trans-isomer of ethyl 3-pentenoate.

12. The gasoline composition of claim 11, wherein component A further comprises at least 20 wt % of cis-isomer of ethyl 3-pentenoate, ethyl 4-pentenoate, or a combination thereof.

13. The gasoline composition of claim 1 comprising component A in the range of from 3.0 to 24 vol. %, based on the overall gasoline composition.

14. The gasoline composition of claim 1 comprising component A in the range of from 3.5 to 23 vol. %, based on the overall gasoline composition.

15. The gasoline composition of claim 1 comprising component A in the range of from 4.0 to 22 vol. %, based on the overall gasoline composition.

16. The gasoline composition of claim 1 wherein component A is selected from the group consisting of methyl butenoate, ethyl butenoate, propyl butenoate, butyl butenoate, methyl pentenoate, ethyl pentenoate, propyl pentenoate, butyl pentenoate, methyl hexenoate, ethyl hexenoate, propyl hexenoate, butyl hexenoate, their methyl substituted analogues, and any combination thereof.

* * * * *